United States Patent [19]

Greaves et al.

[11] Patent Number: 4,692,316

[45] Date of Patent: Sep. 8, 1987

[54] METHOD OF INHIBITING CORROSION IN AQUEOUS SYSTEMS

[75] Inventors: Brian Greaves, Runcorn; Stuart J. Grenside, Gateacre, both of England

[73] Assignee: Dearborn Chemicals Limited, Widnes, United Kingdom

[21] Appl. No.: 713,934

[22] Filed: Mar. 20, 1985

[30] Foreign Application Priority Data

Mar. 20, 1984 [GB] United Kingdom ..... 8407150

[51] Int. Cl.[4] ..... C23F 11/14; C23F 11/18

[52] U.S. Cl. ..... 422/16; 252/389.2; 252/389.5; 252/390; 422/14

[58] Field of Search ..... 422/14, 15, 16; 210/698, 699, 700; 252/390, 394, 395, 396, 389.2, 389.21, 389.5

[56] References Cited

U.S. PATENT DOCUMENTS

| | | | |
|---|---|---|---|
| 2,729,557 | 1/1956 | Booth et al. . | |
| 2,926,154 | 2/1960 | Keim . | |
| 3,036,305 | 5/1962 | Channabasappa et al. . | |
| 3,215,654 | 11/1965 | Schmalz . | |
| 3,240,664 | 3/1966 | Earle, Jr. . | |
| 3,311,594 | 3/1967 | Earle, Jr. . | |
| 3,332,871 | 8/1964 | Robinson . | |
| 3,462,365 | 8/1969 | Vogelsang, Jr. . | |
| 3,623,991 | 11/1971 | Sabatelli et al. . | |
| 3,639,292 | 2/1972 | Gilby . | |
| 3,658,710 | 4/1972 | Puckerius et al. . | |
| 3,752,761 | 8/1973 | Boothe et al. . | |
| 3,793,194 | 2/1974 | Zecher | 210/59 |
| 3,837,803 | 9/1974 | Carter et al. . | |
| 3,982,894 | 9/1975 | Annand et al. . | |
| 3,985,671 | 10/1976 | Clark | 252/180 |
| 4,038,451 | 7/1977 | Brown et al. | 428/274 |
| 4,042,324 | 8/1977 | Auel et al. . | |
| 4,052,160 | 10/1977 | Cook et al. . | |
| 4,057,511 | 11/1977 | Bohnsack et al. . | |
| 4,085,060 | 4/1978 | Vassileff . | |
| 4,297,237 | 10/1981 | Boffardi . | |
| 4,323,461 | 4/1982 | Quinlan . | |
| 4,387,027 | 6/1983 | May et al. . | |
| 4,557,896 | 12/1985 | Brocklebank et al. . | |

FOREIGN PATENT DOCUMENTS

| | | |
|---|---|---|
| 0075514 | 3/1983 | European Pat. Off. . |
| 2310450 | 9/1974 | Fed. Rep. of Germany . |
| 2505435 | 8/1976 | Fed. Rep. of Germany . |
| 1598419 | 8/1970 | France . |
| 2130717 | 11/1972 | France . |
| 2235205 | 1/1975 | France . |
| 1208827 | 10/1970 | United Kingdom . |
| 1297515 | 11/1972 | United Kingdom . |
| 1348595 | 3/1974 | United Kingdom . |
| 1452557 | 10/1976 | United Kingdom . |
| 1486396 | 9/1977 | United Kingdom . |
| 1539974 | 2/1979 | United Kingdom . |
| 1577495 | 10/1980 | United Kingdom . |
| 1589109 | 5/1981 | United Kingdom . |
| 2066234 | 7/1981 | United Kingdom . |
| 2085433A | 4/1982 | United Kingdom . |
| 2105319 | 3/1983 | United Kingdom . |
| 2112370 | 7/1983 | United Kingdom . |

OTHER PUBLICATIONS

Betz Handbook of Industrial Water Conditioning, 7th Ed, 1976, pp. 198–200.

Patent Abstracts of Japan, Unexamined Applications, C Field, vol. 8, No. 184, p. 35 C 239, Aug. 23, 1984.

Research Disclosure 23229; Ciba-Geigy PLC; "Inhibiting Corrosion and Scale Deposition", Aug. 1983.

*Primary Examiner*—Barry S. Richman
*Assistant Examiner*—William R. Johnson
*Attorney, Agent, or Firm*—David E. Heiser

[57] ABSTRACT

A method for inhibiting corrosion in an aqueous system which comprises adding to the system a corrosion inhibiting salt capable of forming a passivating film at the anode, and a substantially linear cationic polymer, is especially useful in cooling water systems and their associated equipment.

48 Claims, No Drawings

METHOD OF INHIBITING CORROSION IN AQUEOUS SYSTEMS

DESCRIPTION

This invention relates to the inhibition of corrosion in aqueous systems, especially in cooling water systems and their associated equipment.

A variety of different anions have been used to inhibit corrosion. These include phosphates, nitrites, chromates, phosphonates and molybdates. The effectiveness of the various anions is not, of course, the same and although many of them are reasonably effective they all possess one or more drawbacks.

In particular, the use of orthophosphate is well established. However, in order for the orthophosphate to be effective in the particular aqueous system, it is quite frequently necessary to use concentrations of orthophosphate greater than 10 ppm. However, the use of these higher concentrations of orthophosphate, in particular, makes it necessary to work in the presence of highly effective anionic dispersants in order to prevent calcium phosphate from fouling the heat exchangers and pipework in the system. The calcium phosphate suspended in the water in this way does not contribute towards corrosion inhibition and can, in fact, cause corrosion because if it is allowed to settle out on ferrous metal parts of the system corrosion can form underneath the resulting deposits and these are, of course, less accessible to the corrosion inhibitor.

Sodium nitrite is also well known as a corrosion inhibitor but it is normally necessary to use it in concentrations of 500–1000 ppm. At these levels the use of nitrite is environmentally unacceptable. Accordingly, therefore, it is not generally possible to use sodium nitrite in spite of its effectiveness.

It is also well known that the use of chromate, particularly when used in combination with zinc salts, provides excellent corrosion protection in aqueous systems. Once again, however, the use of hexavalent chromium salts at concentrations of 15 ppm or more is environmentally unacceptable for toxicity reasons. This has, therefore, considerably curtailed the use of chromate for this purpose.

It has now been found, according to the present invention, that the amounts of a corrosion controlling or inhibiting salt which is capable of forming a passivating or protective anodic film can be reduced significantly if they are used in combination with a cationic polymer. This passivating film is typically of gamma-ferric oxide. It has been found that a useful synergistic effect can be obtained with the result that a composition which is effective in rapidly forming a passivating film and subsequently inhibiting corrosion can be provided which contains much smaller amounts of the corrosion inhibiting salt. Accordingly, the present invention provides a method for inhibiting corrosion in an aqueous system which comprises adding to the system a corrosion inhibiting salt capable of forming a passivating film at the anode or anodic film and a cationic polymer. The present invention is of general applicability both as regards the precise nature of the polymer and the precise nature of the corrosion inhibiting salt. Thus useful synergistic combinations can be obtained with the cationic polymer and corrosion inhibiting salts including phosphates, nitrites, chromates, phosphonates and molybdates, in particular, which are capable of forming a passivating anodic film. These salts are typically water soluble salts, especially alkali metal, in particular sodium or potassium, salts. Ammonium salts are generally not to be recommended as they may promote attack on yellow metals such as copper or brass. The present invention has particular utility when used with orthophosphates such as disodium and trisodium orthophosphate. In general, by using the specified cationic polymers it is possible to use less than 10 ppm of orthophosphate and, indeed, amounts of say 5 ppm, orthophosphate together with a similar quantity of polymer is much more effective than the use of 10 ppm of orthophosphate by itself. Even though orthophosphates by themselves may not form a passivating anodic film at these low concentrations it is believed that such a film is formed when the polymer is present. In addition problems of pitting corrosion can be overcome. In contrast polyphosphates act by forming a film at the cathode and therefore are not suitable for use in the present invention.

The present invention is also applicable, as indicated, with water soluble inorganic nitrites, especially sodium nitrite; normally it is necessary to use 500 to 1000 ppm of sodium nitrite to be effective but such amounts are environmentally unacceptable. By using the polymer in combination with the nitrite it is possible to reduce the concentration of the latter to, say, 45 ppm which is an environmentally acceptable level. Likewise, with water soluble chromates such as potassium chromate it is possible to obtain effective combinations containing as little as, say, 1 ppm of chromate whereas normally amounts of the order of 15 ppm, which are environmentally unacceptable for toxicity reasons, are needed. In addition, the problems of pitting corrosion can be avoided by using the chromate in combination with the specified polymers. Again, the present invention is applicable to phosphonates, preferably phosphonates which contain 3 acid groups which are carboxylic and phosphonic acid groups at least one of which is a phosphonic acid group and at least one of which is a carboxylic acid group, at least the said 3 acid groups being attached to carbon atoms. The present invention is particularly effective when used with 2-phosphono-butane-1,2,4-tricarboxylic acid as well as with nitrilo tris(methylene phosphonic acid) and hydroxyethylidene diphosphonic acid.

A considerable variety of different polymers can be used provided that they are cationic; preferably they are substantially linear i.e. polymers which have substantially no crosslinking but which may contain, for example, cyclic groups in a substantially linear chain. Although it is possible to use, for instance, polyalkyleneimines, typically polyethyleneimines, especially low molecular weight polyethyleneimines, for example 8 molecular weight up to 5,000 and especially up to 2,000 including tetraethylene pentamine and triethylene tetramine, it is generally preferred to use protonated or quaternary ammonium polymers. These quaternary ammonium polymers are preferably derived from ethylenically unsaturated monomers containing a quaternary ammonium group or are obtained by reaction between a polyalkylene polyamine and epichlorohydrin, or by reaction between epichlorhydrin, dimethylamine and either ethylene diamine or polyalkylene polyamine.

Typical cationic polymers which can be used in the present invention and which are derived from an ethylenically unsaturated monomer include homo- and copolymers of vinyl compounds such as (a) vinyl pyridine and vinyl imidazole which may be quaternised with, say a $C_1$ to $C_{18}$ alkyl halide, a benzyl halide, especially a chloride, or dimethyl or diethyl sulphate, or (b) vinyl benzyl chloride which may be quaternised with, say, a tertiary amine of formula $NR_1R_2R_3$ in which $R_1$ $R_2$ and $R_3$ are independently lower alkyl, typically of 1 to 4 carbon atoms, such that one of $R_1$ $R_2$ and $R_3$ can be $C_1$ to $C_{18}$ alkyl; allyl compounds such as diallyldimethyl ammonium chloride; or acrylic derivatives such as (i) a dialkyl aminomethyl(meth)acrylamide which may be quaternised with, say, a $C_1$ to $C_{18}$ alkyl halide, a benzyl halide or dimethyl or diethyl sulphate, (ii) a methacrylamido propyl tri($C_1$ to $C_4$ alkyl, especially methyl-)ammonium salt, or (iii) a (meth)acryloyloxyethyl tri($C_1$ to $C_4$ alkyl, especially methyl)ammonium salt, said salt (ii) or (iii) being a halide, especially a chloride, methosulphate, ethosulphate or 1/n of an n-valent anion. These monomers may be copolymerised with a (meth)acrylic derivative such as acrylamide, an acrylate or methacrylate $C_1$–$C_{18}$ alkyl ester or acrylonitrile. Typical such polymers contain 10–100 mol% of recurring units of the formula:

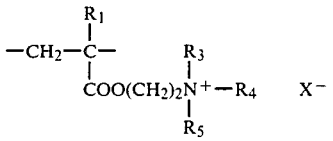

and 0–90 mol% of recurring units of the formula:

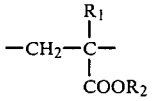

in which $R_1$ represents hydrogen or a lower alkyl radical, typically of 1–4 carbon atoms, $R_2$ represents a long chain alkyl group, typically of 8 to 18 carbon atoms, $R_3$, $R_4$ and $R_5$ independently represent hydrogen or a lower alkyl group while X represents an anion, typically a halide ion, a methosulfate ion, an ethosulfate ion or 1/n of a n valent anion.

Other quaternary ammonium polymers derived from an unsaturated monomer include the homo-polymer of diallyldimethylammonium chloride which possesses recurring units of the formula:

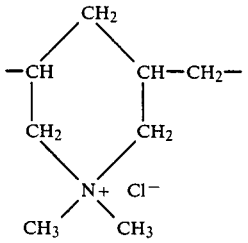

In this respect, it should be noted that this polymer should be regarded as "substantially linear" since although it contains cyclic groupings these groupings are connected along a linear chain and there is no crosslinking.

Other polymers which can be used and which are derived from unsaturated monomers include those having the formula:

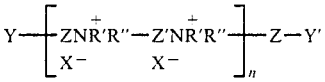

where Z and Z' which may be the same or different is $-CH_2CH{=}CHCH_2-$ or $-CH_2-CHOHCH_2-$, Y and Y', which may be the same or different, are either X or —NH'R", X is a halogen of atomic weight greater than B 30, n is an integer of from 2 to 20, and R' and R" (I) may be the same or different alkyl groups of from 1 to 18 carbon atoms optionally substituted by 1 to 2 hydroxyl groups; or (II) when taken together with N represent a saturated or unsaturated ring of from 5 to 7 atoms; or (III) when taken together with N and an oxygen atom represent the N-morpholino group, which are described in U.S. Pat. No. 4,397,743. A particularly preferred such polymer is poly(dimethylbutenyl)ammonium chloride bis-(triethanol ammonium chloride).

Another class of polymer which can be used and which is derived from ethylenically unsaturated monomers includes polybutadienes which have been reacted with a lower alkyl amine and some of the resulting dialkyl amino groups are quaternised. In general, therefore, the polymer will possess recurring units of the formula:

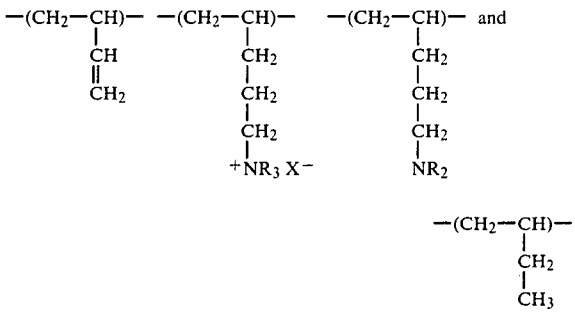

in the molar proportions a:$b_1$:$b_2$:c, respectively, where R represents a lower alkyl radical, typically a methyl or ethyl radical. It should be understood that the lower alkyl radicals need not all be the same. Typical quaternising agents include methyl chloride, dimethyl sulfate and diethyl sulfate. Varying ratios of a:$b_1$:$b_2$:c may be used with the amine amounts ($b_1+b_2$) being generally from 10–90% with (a+c) being from 90%–10%. These polymers can be obtained by reacting polybutadienee with carbon monoxide and hydrogen in the presence of an appropriate lower alkyl amine.

Of the quaternary ammonium polymers which are derived from epichlorohydrin and various amines, particular reference should be made to the polymers described in British Specification Nos. 2085433 and 1486396. A typical amine which can be employed is N,N,N',N'-tetramethylethylenediamine as well as ethylenediamine used together with dimethylamine and triethanolamine. Particularly preferred polymers of this type for use in the present invention are those having the formula:

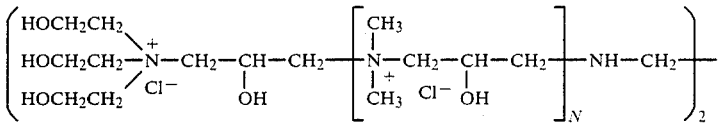

where N is from 0–500, although, of course, other amines can be employed.

Reference should be made to the above British Patent Specifications for futher details.

Other polymers which can be used include protonated polymers such as polymers corresponding to the above quaternary ammonium polymers where the amine groups are not quaternised but are neutralised with acid, such as hydrochloric acid as well as cationic tannin derivatives, such as those obtained by a Mannich-type reaction of tannin (a condensed polyphenolic body) with formaldehyde and an amine, formed as a salt e.g. acetate, formate, hydrochloride. These cationic tannin derivatives can also be quaternised. Further polymers which can be used include the polyamine polymers which have been crosslinked such as polyamideamine/polyethylene polyamine copolymers crosslinked with, say, epichlorohydrin.

The molecular weight of the polymers used can vary within broad limits, say from 250–10 million in some cases although, in general, the molecuar weights will range from 250–1 million, especially 400–10,000.

The amounts of the components used do, of course, depend, to some extent, on the severity of the corrosion conditions but, of course, corrosion inhibiting amounts are desirable. In general, however, from 1–50 ppm, especially from 3–10 ppm, of each will be used and the relative amounts of the two components will generally vary from 1:10 to 10:1 by weight, especially with the polymer concentration being at least as great as that of the salt.

Although the components can be added to the system separately it will generally be more convenient to add them together as a single composition. Accordingly, the present invention also provides a composition suitable for addition to an aqueous system which comprises a cationic polymer and a water soluble corrosion inhibiting salt which is capable of forming a passivating anodic film.

The compositions of the present invention will normally be in the form of an aqueous solution containing, in general, from 1–25% by weight active ingredient (solids). A common concentration is from 5–10% by weight.

The additives used in the present invention can be used, sometimes advantageously, together with other water treatment additives such as phosphonates which do not act anodically such as pentaphosphonomethylene substituted diethylenetriamine, dispersants such as sulphonated and carboxylated polymers, especially copolymers of maleic acid and sulphonated styrene or of methacrylic acid and 2-acrylamido-2-methyl propane sulphonic acid azoles such as benzotriazole and biocides such as isothiazolones, methylene bis(thiocyanate), quaternary ammonium compounds and chlorine release agents. In fact certain of the cationic polymers possess biocidal properties thereby enhancing the effect of the biocides.

The following Examples further illustrate the present invention.

EXAMPLES 1–6

These examples were carried out on a laboratory recirculating rig using a synthetic water possessing 80 ppm calcium hardness, 25 ppm magnesium hardness and 100 ppm "M" alkalinity and pH of 8.6. The temperature of the water was maintained at 130° F. and the rig was first passivated for one day at three times the normal dose level to form a passivating film. The test lasted three days using a flow rate of 2 ft. per second in line and 0.2 ft per second in the tank. Mild steel test coupons were placed in the line and in the tank, corrosion rates being calculated from the weight loss of the coupons during the experiment.

In this test, the additives were orthophosphate in the form of disodium hydrogen phosphate and a cationic polymer (denoted as polymer A) which was a quaternary ammonium compound formed from epichlorohydrin, ethylenediamine, dimethylamine and triethanolamine obtained according to the procedure described in British Specification No. 2085433, having molecular weight of 5,000–6,000. The results obtained are shown in the following table:

| Example No. | Additive | Dose ppm | Corrosion rate, mils. per year: Mild Steel (Line) | Corrosion rate, mils. per year: Mild Steel (Tank) |
|---|---|---|---|---|
| 1 | Orthophosphate/Polymer A | 10/10 | 0.8 | 0.7 |
| 2 | Orthophosphate | 10 | 18.4 | 14.3 |
| 3 | Polymer A | 10 | 58.1 | 73.8 |
| 4 | Orthophosphate | 5 | 25.4 | 16.7 |
| 5 | Polymer A | 5 | 48.9 | 56.2 |
| 6 | Polymer A/Orthophosphate | 5/5 | 1.9 | 1.5 |

These Examples demonstrate the synergistic effect obtained using polymer A in conjunction with the orthophosphate in the prevention of corrosion of mild steel.

EXAMPLES 7–12

The test procedure used in Examples 1–6 was repeated using different polymers.

Polymer B was a copolymer of lauryl methacrylate and methacryloyloxyethyl trimethylammonium metho sulfate (mol ratio 40:60) having a molecular weight of 5,000 while polymer C was a homopolymer of dialyldimethylammonium chloride having a molecular weight of 4,000–5,000. The results obtained are shown in the following table.

| Example No. | Additive | Dose ppm | Corrosion rate, mils. per year: Mild Steel (Line) | Corrosion rate, mils. per year: Mild Steel (Tank) |
|---|---|---|---|---|
| 7 | Polymer B/Orthophosphate | 5/5 | 0.5 | 0.4 |
| 8 | Polymer B/— | 10/— | 88.8 | 53.3 |
| 9 | Polymer C/Orthophosphate | 5/5 | 1.0 | 1.1 |
| 10 | Polymer C/— | 10/— | 63.7 | 41.0 |

-continued

| Example No. | Additive | Dose ppm | Corrosion rate, mils. per year Mild Steel (Line) | Mild Steel (Tank) |
|---|---|---|---|---|
| 11 | —/Orthophosphate | —/10 | 18.4 | 14.3 |
| 12 | No Additive | — | 43.2 | 45.7 |

It is clear from these results that the cationic polymers are not in themselves corrosion inhibitors but act synergistically with the orthophosphate.

EXAMPLES 13–17

The test procedure used in Examples 1–6 was repeated by varying the ratios of the cationic polymers to orthophosphate. By way of comparison sodium hexametaphosphate was used. The results obtained are shown in the following table:

| Example No. | Additive | Dose ppm | Corrosion rate, mils. per year Mild Steel (Line) | Mild Steel (Tank) |
|---|---|---|---|---|
| 13 | Polymer A/Orthophosphate | 10/1.5 | 3.5 | 4.8 |
| 14 | Polymer A/Orthophosphate | 3/5 | 1.8 | 2.2 |
| 15 | Polymer A/Orthophosphate | 5/5 | 1.9 | 1.5 |
| 16 | Polymer A/Orthophosphate | 10/5 | 1.5 | 0.9 |
| 17 | Polymer A/Orthophosphate | 10/10 | 0.8 | 0.7 |
| A | Polymer A/sodium hexametaphosphate | 10/5 | 5.2 | 10.6 |
| B | Sodium hexametaphosphate | 10 | 3.9 | 4.1 |

EXAMPLES 18–20

These examples demonstrate that the combination of the present invention can be employed in an aqueous system in the presence of other additives where interaction with the additive might have been expected.

The test procedure used in the preceding Examples was followed. The results obtained are shown in the following table:

| Example No. | Additive | Dose, ppm | Corrosion Rate, mils. per year Mild Steel (Line) | Mild Steel (Tank) |
|---|---|---|---|---|
| 18 | Polymer A/orthophosphate/ Polymer D/phosphonate A | 3/5/5/5 | 1.5 | 1.4 |
| 19 | Polymer A/orthophosphate/ Polymer D/phosphonate A | 5/5/5/5 | 1.1 | 1.3 |
| 20 | Polymer A/orthophosphate/ Polymer E/phosphate A | 5/5/3/5 | 1.3 | 1.2 |

Polymer D = Copolymer of Acrylic acid/hydroxypropylacrylate (mole ratio 3:1, molecular weight 6000).
Polymer E = Copolymer of methacrylic acid/2 acrylamido 2 methyl propane sulphonic acid (mole ratio 1:1, molecular weight 5000).
Phosphonate A = 2-Phosphonobutane-1,2,4-tricarboxylic acid.

EXAMPLES 21–24

The same test procedure was employed using the ingredients specified in the following table which gives the results obtained:

| Example No. | Additive | Dose ppm | Corrosion Rate mils. per year Mild Steel (Line) | Mild Steel (Tank) |
|---|---|---|---|---|
| 21 | Polymer A/Sodium Hexametaphosphate | 10/10 | 2.7 | 3.7 |
| 22 | Polymer A/orthophosphate | 10/10 | 0.8 | 0.7 |
| 23 | Phosphonate A/Polymer F/ Orthophosphate | 6/2.5/3 | 1.6 (Pitting corrosion evident) | 1.9 |
| 24 | Phosphonate A/Polymer A/ Orthophosphate | 6/2.5/3 | 0.8 (No pitting corrosion) | 1.3 |

Polymer F = polymethacrylic acid of molecular weight 5,400.

All phosphate concentrations are calculated as $PO_4$.

It is clear from Examples 21 and 22 that the present invention is more effective when using a combination of polymer and orthophosphate than a combination of the same polymer and a polyphosphate.

Examples 23 and 24 illustrate the fact that the presence of the cationic polymer inhibits pitting corrosion when small concentrations of orthophosphates are employed.

EXAMPLES 25–27

These Examples illustrate the effectiveness of 3 further cationic polymers in the presence of orthophosphate. The same test procedure was used.

| Example No. | Additive | Dose ppm | Corrosion Rate, mils. per year Mild Steel (Line) | Mild Steel (Tank) |
|---|---|---|---|---|
| 25 | Polymer G/Orthophosphate | 10/10 | 0.8 | 0.6 |
| 26 | Polymer H/Orthophosphate | 5/5 | 1.8 | 3.6 |
| 27 | Polymer I/Orthophosphate | 10/10 | 1.2 | 1.0 |

Polymer G = Aminomethylated polybutadiene, molecular weight 1300, with a medium degree of amine incorporation.
Polymer H = Aminomethylated polybutadiene, molecular weight 2000, with high amine incorporation.
Polymer I = Polyethyleneimine, molecular weight 1800.

EXAMPLES 28–32

These Examples illustrate the effectiveness of the cationic polymers when used with sodium nitrite at a much lower concentration than that usually employed while obtaining acceptable corrosion rates.

Test: Conditions as in Examples 1–27

| Example No. | Additive | Dose ppm | Corrosion Rate, mils. per year Mild Steel (Line) | Mild Steel (Tank) |
|---|---|---|---|---|
| 28 | Polymer A/Sodium Nitrite | 10/45 | 2.3 | 2.6 |
| 29 | Polymer A/Sodium Nitrite | 7.5/45 | 3.2 | 4.4 |
| 30 | Polymer A/Sodium Nitrite | 5/45 | 9.1 | 11.2 |
| 31 | Polymer A/Sodium Nitrite | 3/45 | 12.4 | 11.3 |
| 32 | Polymer A/Sodium Nitrite | /45 | 15.7 | 34.8 |

EXAMPLES 33–35

These Examples illustrate the effectiveness of the cationic polymer in obtaining synergistic results with chromate, the chromate concentration being very low.

The results obtained, using the same test procedure, are shown below.

| Test: Conditions as for Examples 1-32 | | | | |
|---|---|---|---|---|
| | | | Corrosion Rate, mils. per year | |
| Example No. | Additive | Dose ppm | Mild Steel (Line) | Mild Steel (Tank) |
| 33 | Polymer A/Chromate | 3/3 | 2.0 | 2.0 |
| 34 | Polymer A/Chromate | 7.5/2 | 2.6 | 2.9 |
| 35 | Polymer A/Chromate | 7.5/1 | 3.0 | 2.9 |
| 36 | Polymer A/Chromate | —/3 | 8.8* | 8.9* |

*Pitting corrosion evident on these test coupons.

The chromate was added as potassium chromate (this is not critical) and the dose expressed as $CrO_4$. These results also indicate the usefulness of Polymer A in alleviating the problem of pitting corrosion.

EXAMPLES 35-39

These Examples demonstrate the effectiveness of the cationic polymers when used with a phosphonate.

| Test: Conditions as for Examples 1-36 | | | | |
|---|---|---|---|---|
| | | | Corrosion Rate, mils. per year | |
| Example No. | Additive | Dose ppm | Mild Steel (Line) | Mild Steel (Tank) |
| 37 | Polymer A | 10 | 58.1 | 73.8 |
| 38 | Phosphonate A | 10 | 21.7 | 22.7 |
| 39 | Polymer A/Phosphonate A | 5/5 | 4.8 | 8.6 |

EXAMPLES 40-41

These Examples demonstrate the effectiveness of further types of cationic polymer in combination with a salt capable of forming an anodic passivating film.

| | | | Corrosion Rate, mils. per year | |
|---|---|---|---|---|
| Example No. | Additive | Dose ppm | Mild Steel (Line) | Mild Steel (Tank) |
| 40 | Cationic Tannin/o-phosphate | 10/10 | 1.5 | 2.3 |
| 41 | Cross-linked Polyamide-amine-polyethylene polyamine co-polymer/o-phosphate | 5/5 | 1.0 | 1.0 |

EXAMPLES 42-44

The following Examples illustrate the ability of the cationic polymer to enable one to use very small amounts of corrosion inhibiting salt. The results obtained are shown in the following table:

| | | | Corrosion Rate, mils. per year | |
|---|---|---|---|---|
| Example No. | Additives | Dose, ppm | Mild Steel (Line) | Mild Steel (Tank) |
| 42 | Polymer I/Orthophosphate | 10/3 | 5.4 | 7.5 |
| 43 | Polymer A/Orthophosphate | 10/3 | 2.2 | 2.4 |
| 44 | Polymer A/Orthophosphate | 10/1.5 | 3.5 | 4.8 |
| 45 | Triethylene Tetramine/orthophosphate | 10/3 | 2.4 | 5.1 |
| 46 | Tetraethylene Pentamine/orthophosphate | 10/3 | 1.2 | 2.6 |

We claim:

1. A method for inhibiting corrosion in an aqueous system which comprises adding to the system at least one corrosion inhibiting salt capable of forming a passivating film at the anode selected from the group of salts consisting of 2-phosphono-butane-1,2,4-tricarboxylic acid salts, orthophosphates, nitrites, and chromates, and a substantially linear cationic polymer having a molecular weight between about 400 and about 10,000; said polymer containing quaternary ammonium groups or protonated amine groups and being derived from reacting epichlorohydrin with amines selected from the group consisting of dimethylamine, triethanolamine, ethylene diamine and polyalkylene polyamines; and said polymer being added in an effective amount to significantly reduce the amount of said salt needed in the system for corrosion protection.

2. A method according to claim 1 in which the the salt is an alkali metal salt.

3. A method according to claim 1 in which the salt is disodium or trisodium orthophosphate, sodium nitrite, potassium chromate, or a salt of 2-phosphono-butane-1,2,4-tricarboxylic acid.

4. A method according to claim 1 in which the polymer is one obtained by a reaction between a polyalkylene polyamine and epichlorohydrin.

5. A method according to claim 1 in which the cationic polymer contains quaternary ammonium groups.

6. A method according to claim 1 in which the cationic polymer has the formula:

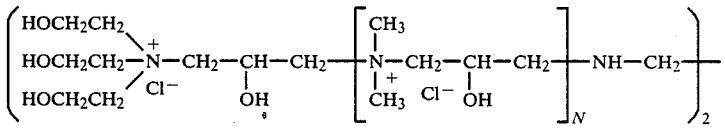

where N is from 0-500.

7. A method according to claim 1 wherein the salt consists essentially of orthophosphate incorporated at about 10 ppm or less.

8. A method according to claim 1 wherein the salt consists essentially of nitrite added at about 45 ppm or less.

9. A method according to claim 1 wherein the salt consists essentially of chromate added at about 3 ppm or less.

10. A method according to claim 1 in which the salt consists essentially of orthophosphate.

11. A method according to claim 1 in which the polymer is obtained by a reaction between epichlorohydrin and amines including ethylene diamine.

12. A method according to claim 11 in which the amines reacted to obtain the polymer further include triethanolamine.

13. A method according to claim 12 in which the amines reacted to obtain the polymer further include dimethylamine.

14. A composition suitable for addition to an aqueous system which comprises at least one water soluble corrosion inhibiting salt which is capable of forming a passivating film at the anode selected from the group of salts consisting of 2-phosphono-butane-1,2,4-tricarboxylic acid salts, orthophosphates, nitrites, and chromates, and a substantially linear cationic polymer having a molecular weight between about 400 and about 10,000; said polymer containing quaternary ammonium groups or protonated amine groups and being derived from reacting epichlorohydrin with amines selected from the group consisting of dimethylamine, triethanolamine, ethylene diamine and polyalkylene polyamines.

15. A composition according to claim 14 in which the salt is disodium or trisodium orthophosphate, sodium nitrite, potassium chromate, or a salt of 2-phosphono-butane-1,2,4-tricarboxylic acid.

16. A composition according to claim 14 in which the polymer is one obtained by a reaction between a polyalkylene polyamine and epichlorohydrin.

17. A composition according to claim 14 in which the cationic polymer contains quaternary ammonium groups.

18. A composition according to claim 14 in which the cationic polymer has the formula:

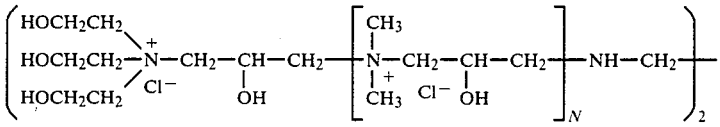

where N is from 0–500.

19. A composition according to claim 14 which also contains a phosphonate which does not act anodically, a dispersant, an azole, or a biocide.

20. A composition according to claim 19 in which the said phosphonate is pentaphosphonomethylene substituted diethylenetriamine, the dispersant is a copolymer of maleic acid and sulphonated styrene or of methacrylic acid and 2-acrylamido-2-methylpropane sulphonic acid, the azole is benzotriazole and the biocide is an isothiazolone, methylene bis(thiocyanate), a quaternary ammonium compound or a chlorine release agent.

21. A composition according to claim 14 in which the salt is not an ammonium salt.

22. A composition according to claim 21 in which the salt is an alkali metal salt.

23. A composition according to claim 14 in which the polymer is obtained by a reaction between epichlorohydrin and amines including ethylene diamine.

24. A composition according to claim 23 in which the amines reacted to obtain the polymer further include triethanolamine.

25. A composition according to claim 24 in which the amines reacted to obtain the polymer further include dimethylamine.

26. A method for inhibiting corrosion in an aqueous system which comprises adding to the system a corrosion inhibiting orthophosphate salt capable of forming a passivating film at the anode, and a substantially linear cationic polymer having a molecular weight between about 400 and about 10,000; said cationic polymer being derived by polymerizing ethylenically unsaturated monomers and incorporating quaternary ammonium groups or protonated amine groups therein, and said polymer being selected from the group consisting of (i) polymers containing 10 to 100 mol % of recurring units of the formula:

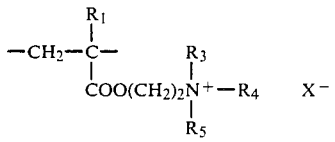

and 0 to 90 mol % of recurring units of the formula:

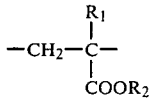

in which $R_1$ represents hydrogen or a lower alkyl radical, $R_2$ represents a long chain alkyl group having 8 to 18 carbons, $R_3$, $R_4$, and $R_5$ independently represent hydrogen or a lower alkyl group while X represents a anion;

(ii) polymers possessing recurring units of the formula;

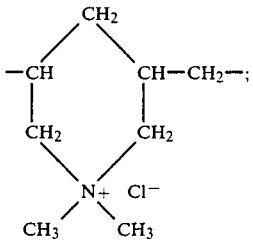

and (iii) polymers possessing recurring units of:

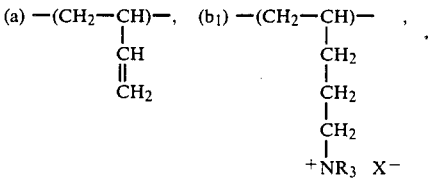

-continued

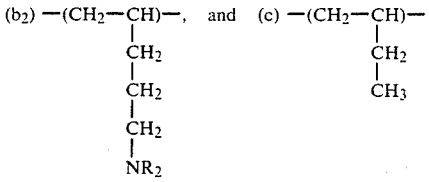

in the molar proportions $a:b_1:b_2:c$ respectively, where each R independently represents a lower alkyl radical; and said polymer being added in an effective amount to significantly reduce the amount of said salt needed in the system for corrosion protection.

27. A method according to claim 26 in which the cationic polymer is that of paragraph (i) therein.

28. A method according to claim 26 in which the cationic polymer is a copolymer of lauryl methacrylate and methacroyloxyethyl trimethylammonium metho sulfate.

29. A method according to claim 26 in which the cationic polymer is that of paragraph (ii) therein.

30. A method according to claim 26 in which the cationic polymer is a homopolymer of diallyl(dimethylammonium chloride).

31. A method according to claim 26 in which the cationic polymer is that of paragraph (iii) therein.

32. A method according to claim 26 in which the cationic polymer is an aminomethylated polybutadiene.

33. A composition suitable for addition to an aqueous system which comprises a water-soluble corrosion inhibiting orthophosphate salt capable of forming a passivating film at the anode and a substantially linear cationic polymer having a molecular weight between about 400 and about 10,000; said cationic polymer being derived from polymerizing ethylenically unsaturated monomers and incorporating quaternary ammonium groups or protonated amine groups therein, and said polymer being selected from the group consisting of (i) polymers containing 10 to 100 mol % of recurring units of the formula:

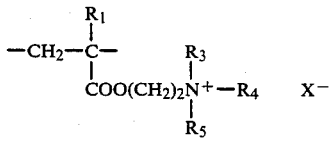

and 0 to 90 mol % of recurring units of the formula:

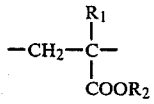

in which $R_1$ represents hydrogen or a lower alkyl radical, $R_2$ represents a long chain alkyl group having 8 to 18 carbons, $R_3$, $R_4$, and $R_5$ independently represent hydrogen or a lower alkyl group while X represents a anion;

(ii) polymers possessing recurring units of the formula:

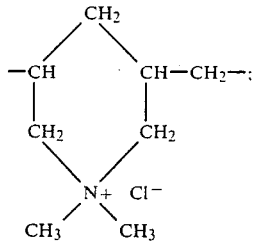

and (iii) polymers possessing recurring units of:

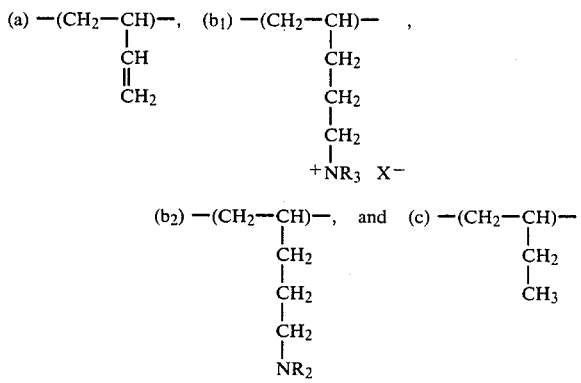

where each R independently represents methyl or ethyl, and where $(b_1+b_2)$ is from about 10 to about 90 percent of said recurring units, and $(a+c)$ is from about 90 to about 10 percent of said recurring units.

34. A composition according to claim 33 in which the cationic polymer is that of paragraph (i) therein.

35. A composition according to claim 33 in which the cationic polymer is a copolymer of lauryl methacrylate and methacroyloxyethyl trimethylammonium metho sulfate.

36. A composition according to claim 33 in which the cationic polymer is that of paragraph (ii) therein.

37. A composition according to claim 33 in which the cationic polymer is a homopolymer of diallyl(dimethylammonium chloride).

38. A composition according to claim 33 in which the cationic polymer is that of paragraph (iii) therein.

39. A composition according to claim 33 in which the cationic polymer is an aminomethylated polybutadiene.

40. A method according to claim 1 in which the cationic polymer and salts are each present in an amount from 1 to 50 ppm.

41. A method according to claim 40 in which the cationic polymer and salts are each present in an amount from 3 to 10 ppm.

42. A method according to claim 1 in which the relative amount of the polymer and salt is from 1:10 to 10:1 by weight.

43. A method according to claim 1 in which the concentration of polymer is at least as great as that of the salt.

44. A method according to claim 1 in which the aqueous system is a cooling system.

45. A composition according to claim 14 which is in the form of an aqueous solution.

46. A composition according to claim 14 in which the active ingredients are present in an amount from 1 to 25% by weight.

47. A composition according to claim 14 in which the relative amounts of the two components is from 1:10 to 10:1 by weight.

48. A composition according to claim 14 in which the concentration of polymer is at least as great as that of the salt.

* * * * *